US009552781B2

(12) United States Patent
Takagi

(10) Patent No.: US 9,552,781 B2
(45) Date of Patent: Jan. 24, 2017

(54) CONTENT ADAPTIVE LCD BACKLIGHT CONTROL

(71) Applicant: Intel Corporation, Santa Clara, CA (US)

(72) Inventor: Akihiro Takagi, San Mateo, CA (US)

(73) Assignee: Intel Corporation, Santa Clara, CA (US)

( * ) Notice: Subject to any disclaimer, the term of this patent is extended or adjusted under 35 U.S.C. 154(b) by 391 days.

(21) Appl. No.: 13/843,632

(22) Filed: Mar. 15, 2013

(65) Prior Publication Data

US 2014/0267466 A1 Sep. 18, 2014

(51) Int. Cl.

| | |
|---|---|
| ***G09G 5/10*** | (2006.01) |
| ***G09G 3/36*** | (2006.01) |
| ***G09G 3/34*** | (2006.01) |

(52) U.S. Cl.

CPC ..... *G09G 3/36* (2013.01); *G09G 3/3406* (2013.01); *G09G 2320/0271* (2013.01); *G09G 2320/0633* (2013.01); *G09G 2320/0646* (2013.01); *G09G 2330/021* (2013.01); *G09G 2360/16* (2013.01)

(58) Field of Classification Search

CPC G09G 3/3406; G09G 3/36; G09G 2320/0633; G09G 2320/0646; G09G 2320/0271; G09G 2330/021; G09G 3/342; G09G 2320/062; G09G 2360/16

See application file for complete search history.

(56) References Cited

U.S. PATENT DOCUMENTS

| | | | |
|---|---|---|---|
| 6,633,687 | B1 | 10/2003 | Cui |
| 7,119,786 | B2 | 10/2006 | Cui |
| 7,149,909 | B2 | 12/2006 | Cui et al. |
| 7,233,309 | B2 | 6/2007 | Diefenbaugh et al. |
| 7,259,769 | B2 | 8/2007 | Diefenbaugh et al. |
| 7,348,957 | B2 | 3/2008 | Cui et al. |
| 7,477,228 | B2 | 1/2009 | Wyatt |
| 7,742,032 | B2 | 6/2010 | Diefenbaugh et al. |
| 8,358,262 | B2 | 1/2013 | Degwekar et al. |
| 2005/0057484 | A1 | 3/2005 | Diefenbaugh et al. |
| 2005/0057485 | A1 | 3/2005 | Diefenbaugh et al. |
| 2006/0092182 | A1 | 5/2006 | Diefenbaugh et al. |

(Continued)

FOREIGN PATENT DOCUMENTS

| | | | |
|---|---|---|---|
| JP | 2007322945 | A | 12/2007 |
| KR | 20110060268 | A | 6/2011 |

(Continued)

OTHER PUBLICATIONS

Taiwan IPO Search Report, Taiwan Invention Patent Application No. 103107447, completed Dec. 11, 2015, 2 pages.

(Continued)

*Primary Examiner* — Andrew Sasinowski
*Assistant Examiner* — Brent D. Castiaux
(74) *Attorney, Agent, or Firm* — International IP Law Group, P.L.L.C.

(57) ABSTRACT

An apparatus, computing device, and a computer readable medium are described herein. The apparatus includes logic to process pixels using content adaptive LCD backlight control. The apparatus also includes logic to perform analog current level control dimming when processing the pixels, and logic to linearly compensate for the analog current level control dimming when processing the pixels.

21 Claims, 7 Drawing Sheets

(56) References Cited

U.S. PATENT DOCUMENTS

| | | | | |
|---|---|---|---|---|
| 2009/0267876 | A1* | 10/2009 | Kerofsky | G09G 3/3413 345/87 |
| 2009/0303215 | A1* | 12/2009 | Shiozaki | G09G 3/3406 345/207 |
| 2010/0164998 | A1 | 7/2010 | Li et al. | |
| 2010/0295874 | A1 | 11/2010 | Liu et al. | |
| 2011/0128302 | A1 | 6/2011 | Cho et al. | |
| 2011/0141002 | A1* | 6/2011 | Kim | G09G 3/342 345/102 |
| 2011/0175938 | A1* | 7/2011 | Lee | G09G 3/3406 345/690 |
| 2011/0187760 | A1 | 8/2011 | Li et al. | |
| 2012/0019154 | A1 | 1/2012 | Chen et al. | |
| 2012/0086701 | A1 | 4/2012 | Vaananen et al. | |

FOREIGN PATENT DOCUMENTS

| | | | |
|---|---|---|---|
| KR | 1020110060268 | | 6/2011 |
| KR | 1020110068151 | | 6/2011 |
| KR | 20120038180 | A | 4/2012 |
| TW | 201118843 | A | 6/2011 |
| TW | 201128617 | A | 8/2011 |
| TW | 201206235 | A | 2/2012 |
| TW | 201506893 | A | 2/2015 |

OTHER PUBLICATIONS

International Search Report, PCT No. PCT/US2014/023078, mailed on Jul. 14, 2014, 3 pages.

Masakazu Honda, Masakazu Honda's weekly mobile communication, Use power for a display more smart, Sep. 25, 2009, PC Watch, URL: http://pc.watch.impress.co.jp/docs/column/mobilm/317568.html, 10 pages.

European Search Report, EP Application No. 14768863, completed Jul. 14, 2016, 4 pages.

* cited by examiner

100

200

300

500

600

CONTENT ADAPTIVE LCD BACKLIGHT CONTROL

TECHNICAL FIELD

The present invention relates generally to a liquid crystal display (LCD) panel with a light emitting diode (LED) backlight. More specifically, the present invention relates to content adaptive LCD backlight control with a non-linearity compensation mechanism.

BACKGROUND ART

A display that includes an LCD panel with an LED backlight can illuminate the LCD panel by placing a combination of white or Red, Green, and Blue (RGB) LED arrays behind the LCD panel. The LED backlight equipped LCD panel enables the images with a high luminance to be rendered while also displaying deep, dark colors. Luminance is a measure of brightness from a particular surface, with units measured in candela per square meter (cd/m2). The LED backlight can be dimmed by using pulse width modulation (PWM) to control the power input to the LED arrays. The application of PWM causes the backlight to rapidly turn on and off. The value of the PWM frequency is selected at value that eliminates flicker perception by human eyes while enabling a brightness change related to a PWM duty ratio to be perceived. By varying the PWM duty ratio of the LED backlight, the power consumption of the LED backlight may also be varied.

BRIEF DESCRIPTION OF THE DRAWINGS

The same numbers are used throughout the disclosure and the figures to reference like components and features. Numbers in the 101 series refer to features originally found in FIG. 1; numbers in the 200 series refer to features originally found in FIG. 2; and so on.

DESCRIPTION OF THE EMBODIMENTS

Figure 1:
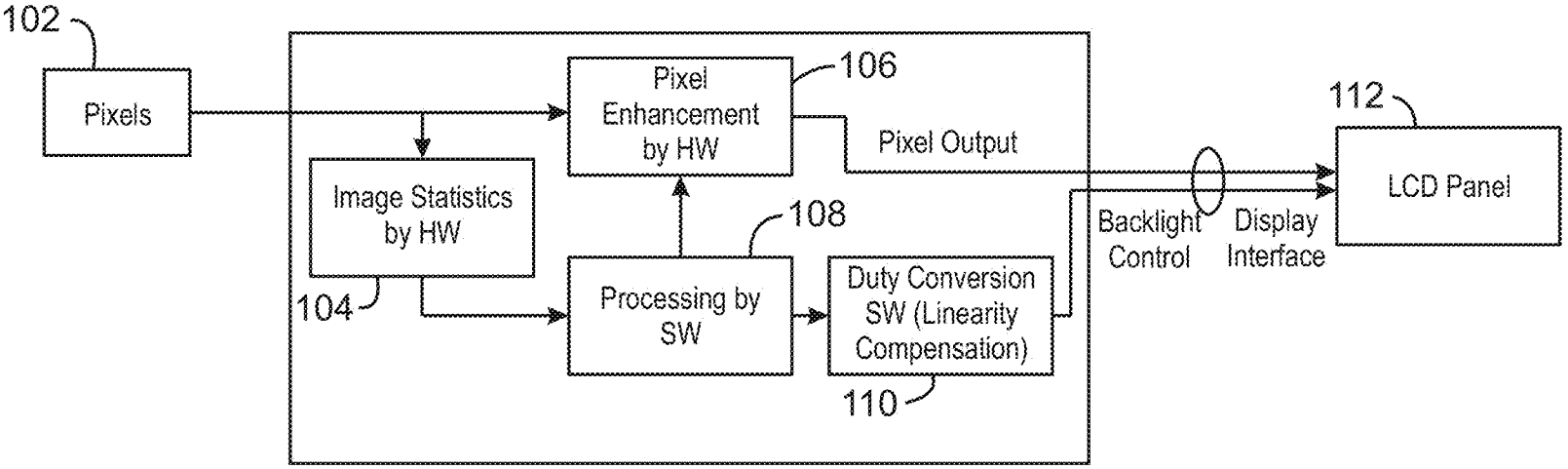
FIG. 1 is a block diagram of content adaptive LCD backlight control with analog current level control dimming.

Content adaptive LCD backlight control may be used to reduce the LED backlight power for internal panels of a display by lowering the backlight level based on the content being rendered. As the backlight is lowered, the pixel values are modified to compensate for the change in backlight level. In this manner, power consumption is reduced. The techniques used by content adaptive LCD backlight control work in conjunction with pulse width modulation (PWM) to dim the LED backlight. Accordingly, a PWM dimming type LED driver circuit may be used to dim the LED backlight. The PWM dimming type LED driver circuit exhibits a linear relationship between the duty cycle of the brightness control input to the LED backlight and the luminance produced by the LED backlight, where the duty cycle is a comparison of the amount of time the LED backlight is turned "on" with the amount of time the LED backlight is turned "off." Because the techniques used by content adaptive LCD backlight control work in conjunction with PWM to dim the LED backlight, content adaptive LCD backlight control operates with the LED backlight dimmed in a linear fashion.

Embodiments described herein include analog current level control dimming with linearity compensation for the content adaptive LCD backlight control. The content adaptive LCD backlight control may be applied to an LED backlight equipped LCD panel with an analog current level control dimming type LED driver circuit. A determination of how much to change the backlight level is made based on non-linearity compensation data and image statistics. The pixels may be enhanced or modified based on the change in the backlight level. In some embodiments, dimming the LED backlight using analog current level control dimming enables a greater reduction in power consumption when compared to the dimming the backlight using PWM. Moreover, in some embodiments, content adaptive LCD backlight control may include Intel® Display Power Saving Technology (DPST).

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the inventions. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

FIG. 1 is a block diagram of content adaptive LCD backlight control 100 with analog current level control dimming. In some embodiments, analog current level control dimming refers to adjusting the LED backlight by adjusting the current levels to the LED backlight. A plurality of pixels 102 may be input into the content adaptive LCD backlight control 100. The plurality of pixels 102 may be obtained from any component of a computing device that uses the content adaptive LCD backlight control 100. Further, the plurality of pixels may be streamed to a buffer for processing by the content adaptive LCD backlight control 100. In some embodiments, each pixel represents pixel data, where the pixel data refers to any parameter used to describe a pixel.

At block 104, image statistics are obtained from the plurality of pixels 102 that are input into the content adaptive LCD backlight control 100. The image statistics 104 may be used to calculate a histogram of the pixel data. In some embodiments, the histogram may be generated based on a Y value of the YUV color space. Furthermore, in some embodiments, the Y value may be created from a Red-Green-Blue (RGB) color source as follows: $Y=0.299R+0.587G+0.114B$. In some embodiments, the image statistics 104 may be obtained using graphics hardware. The plurality of pixels 102 are also used as a basis for pixel enhancement at block 106. In some embodiments, the pixel enhancement may be performed using graphics hardware.

At block 108, the image statistics may be processed to determine a brightness setting value. Specifically, the image statistics may be processed to obtain a required PWM duty ratio for the LED backlight. The resulting brightness setting value for the LED backlight is sent to block 106, where it is used to calculate the pixel enhancements to apply to the incoming pixels. The brightness setting value for the LED backlight is also sent to block 110 where a linearity compensation is applied in order to compensate for the non-linear dimming. The enhanced pixels are sent from block 106 to an LCD panel 112. Additionally, the analog current level control dimming value with linearity compensation is sent to the LCD panel 112 for backlight control. Accordingly, an analog current level control dimming value may be obtained when linearly compensating for the analog current level control dimming, a plurality of enhanced pixels obtained when performing analog current level control dimming when processing the pixels, and a liquid crystal display (LCD) panel with a light emitting diode (LED) backlight display setting obtained by combining the analog current level control dimming value and the plurality of enhanced pixels.

Figure 2:
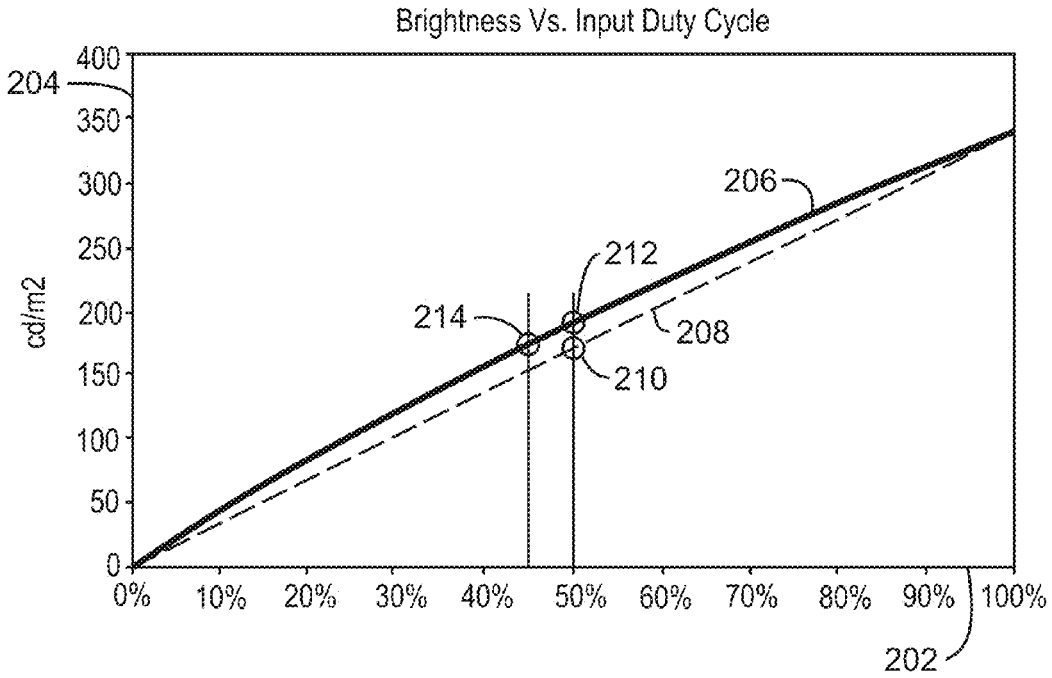
FIG. 2 is a graph illustrating the relationship between the input duty cycle and the resulting luminance expected by content adaptive LCD backlight control.

FIG. 2 is a graph 200 illustrating the relationship between the input duty cycle and the resulting luminance expected by content adaptive LCD backlight control. The x-axis 202 represents the input duty cycle while the y-axis 204 represents the luminance of the LED backlight equipped LCD panel. Further, the graph 200 illustrates the analog current level control dimming 206 using a solid line and the PWM dimming 208 using a dashed line.

The analog current level control dimming 206 results in a curved, non-linear graph as the input duty cycle increases for each cycle. As a result, in some embodiments, the analog current level control dimming results in an adjustment of the LED current level. The PWM dimming 208 results in a more linear graph as the input duty cycle increases when compared to the analog current level control dimming 206. At an input duty cycle of 50%, the content adaptive LCD backlight control expects a luminance of approximately 175 cd/m2, as provided by the PWM dimming 208 at reference point 210 on the graph 200. At an input duty cycle of 50%, the analog current level control dimming 206 will cause a luminance of approximately 190 cd/m2. As a result, at the same input duty cycle for their respective input currents, the analog current level control dimming 206 provides too much luminance for use with the content adaptive LCD backlight control techniques.

Accordingly, the analog current level control dimming 206 can be used with the content adaptive LCD backlight control techniques at a lower input duty cycle when compared to the PWM dimming 208. As shown on the graph 200, the analog current level control dimming 206 can provide the content adaptive LCD backlight control a luminance of approximately 175 cd/m2 at reference number 214, where the input duty cycle is 46%. In order to enable analog current level control dimming in conjunction with the content adaptive LCD backlight control, the input cycle for analog current level control dimming may be compensated for in order to work in conjunction with content adaptive LCD backlight control. In some embodiments, the analog current level control dimming is reduced. Further, in some embodiments, a linearity algorithm is applied to the analog current level control dimming. In this manner, the content adaptive LCD backlight control will not be over bright.

Figure 3:
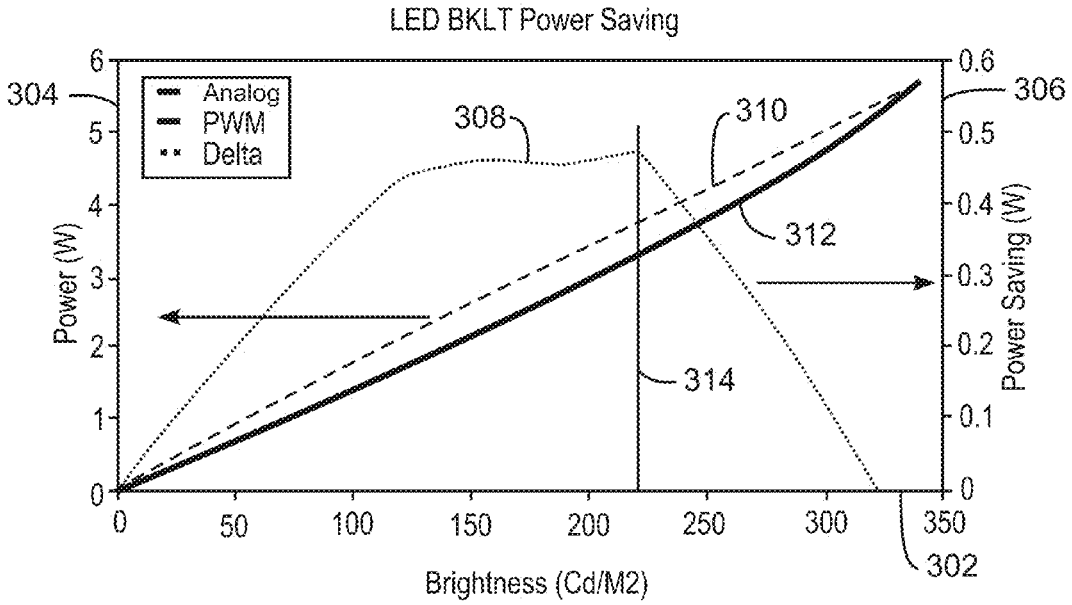
FIG. 3 is a graph illustrating the power savings among LED backlight dimming techniques.

FIG. 3 is a graph 300 illustrating the power savings among LED backlight dimming techniques. The x-axis 302 represents the brightness, or luminance, of the LED backlight when the dimming techniques are used with the content adaptive LCD backlight control. To the left of the graph 300, the y-axis 304 illustrates the power consumed in Watts (W) for the dimming techniques. To the right of the graph 300, the y-axis 306 illustrates the power saved as applied to a line 308 on the graph 300.

A line 310 represents the power consumed using PWM dimming with the content adaptive LCD backlight control. A line 312 represents the power consumed using analog current level control dimming with the content adaptive LCD backlight control. As shown, the analog current level control dimming with the content adaptive LCD backlight control consumes less power when compared to PWM dimming with the content adaptive LCD backlight control. For example, at a luminance of approximately 220 cd/m2 at reference line 314, the analog current level control dimming consumes approximately 0.48 W less than the PWM dimming. A power savings of approximately 0.4 W to 0.5 W occurs between a luminance of 100 cd/m2 and 220 cd/m2.

Figure 4:
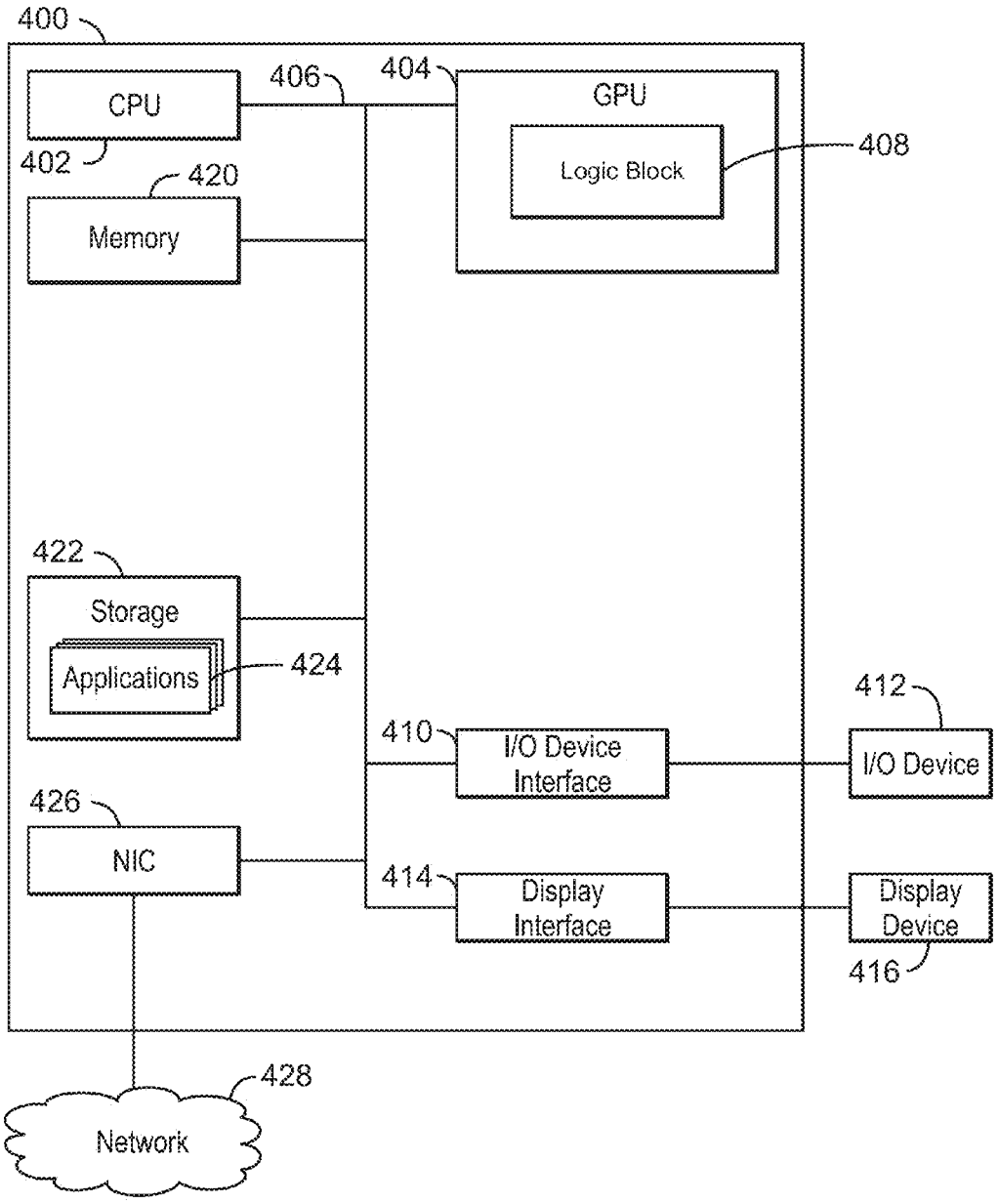
FIG. 4 is a block diagram of a computing device that may be used to enable content adaptive LCD backlight control with analog current level control dimming and linearity conversion.

FIG. 4 is a block diagram of a computing device 400 that may be used to enable content adaptive LCD backlight control with analog current level control dimming and linearity conversion. The device 400 may be, for example, a laptop computer, desktop computer, tablet computer, mobile device, server, or cellular phone, among others. The computing device 400 may include a central processing unit (CPU) 402 that is configured to execute stored instructions, as well as a memory device 420 that stores instructions that are executable by the CPU 402. The CPU 402 can be a single core processor, a multi-core processor, a computing cluster, or any number of other configurations. Furthermore, the computing device 400 may include more than one CPU 402. The instructions that are executed by the CPU 402 may be used to enable content adaptive LCD backlight control with analog current level control dimming and linearity conversion.

The computing device 400 may also include a graphics processing unit (GPU) 404. As shown, the CPU 402 may be connected through a bus 406 to the GPU 404. However, in some embodiments, the CPU 402 and the GPU 404 are located on the same die. The GPU 404 may be configured to perform any number of graphics operations within the computing device 400. For example, the GPU 404 may be configured to render or manipulate graphics images, graphics frames, videos, or the like, to be displayed to a user of the computing device 400.

The GPU 404 may also include a content adaptive LCD backlight control content adaptive LCD backlight control logic block DPST 408. The control logic may be a component of the GPU 404 with one or more control logic blocks that may be used for parallel processing of data sent to the GPU 404. Accordingly, although one content adaptive LCD backlight control logic block is shown, the GPU may contain any number of logic blocks. The content adaptive LCD backlight control logic block may be used to enable content adaptive LCD backlight control with analog current level control dimming and linearity conversion.

The CPU 402 may also be connected through the bus 406 to an input/output (I/O) device interface 410 configured to connect the computing device 400 to one or more I/O devices 412. The I/O devices 412 may include, for example, a keyboard and a pointing device, wherein the pointing device may include a touchpad or a touchscreen, among others. The I/O devices 412 may be built-in components of the computing device 400, or may be devices that are externally connected to the computing device 400.

The CPU 402 may also be linked through the bus 406 to a display interface 414 configured to connect the computing device 400 to a display device 416. The display device 416 may include a display screen that is a built-in component of the computing device 400. The display device 416 may also include a computer monitor, television, or projector, among others, that is externally connected to the computing device 400.

The memory device 420 can include random access memory (RAM), read only memory (ROM), flash memory, or any other suitable memory systems. For example, the memory device 420 may include dynamic random access memory (DRAM). The computing device 400 may also include a storage 422. The storage 422 is a physical memory such as a hard drive, an optical drive, a thumbdrive, an array of drives, or any combinations thereof. The storage 422 may also include remote storage drives. The storage may also include one or more media applications 424. In some embodiments, the applications 424 include an application for video playback.

A network interface controller (NIC) 426 may be configured to connect the computing device 400 through the bus 406 to a network 428. Network 428 can be a wire line network, a wireless network, or a cellular network. The network 428 may be any wide area network (WAN), any local area network (LAN), or the Internet, among others. For example, network 428 can be 3GPP LTE network or a WiFi network.

The block diagram of FIG. 4 is not intended to indicate that the computing device 400 is to include all of the components shown in FIG. 4. Further, the computing device 400 may include any number of additional components not shown in FIG. 4, depending on the details of the specific implementation.

Figure 5:
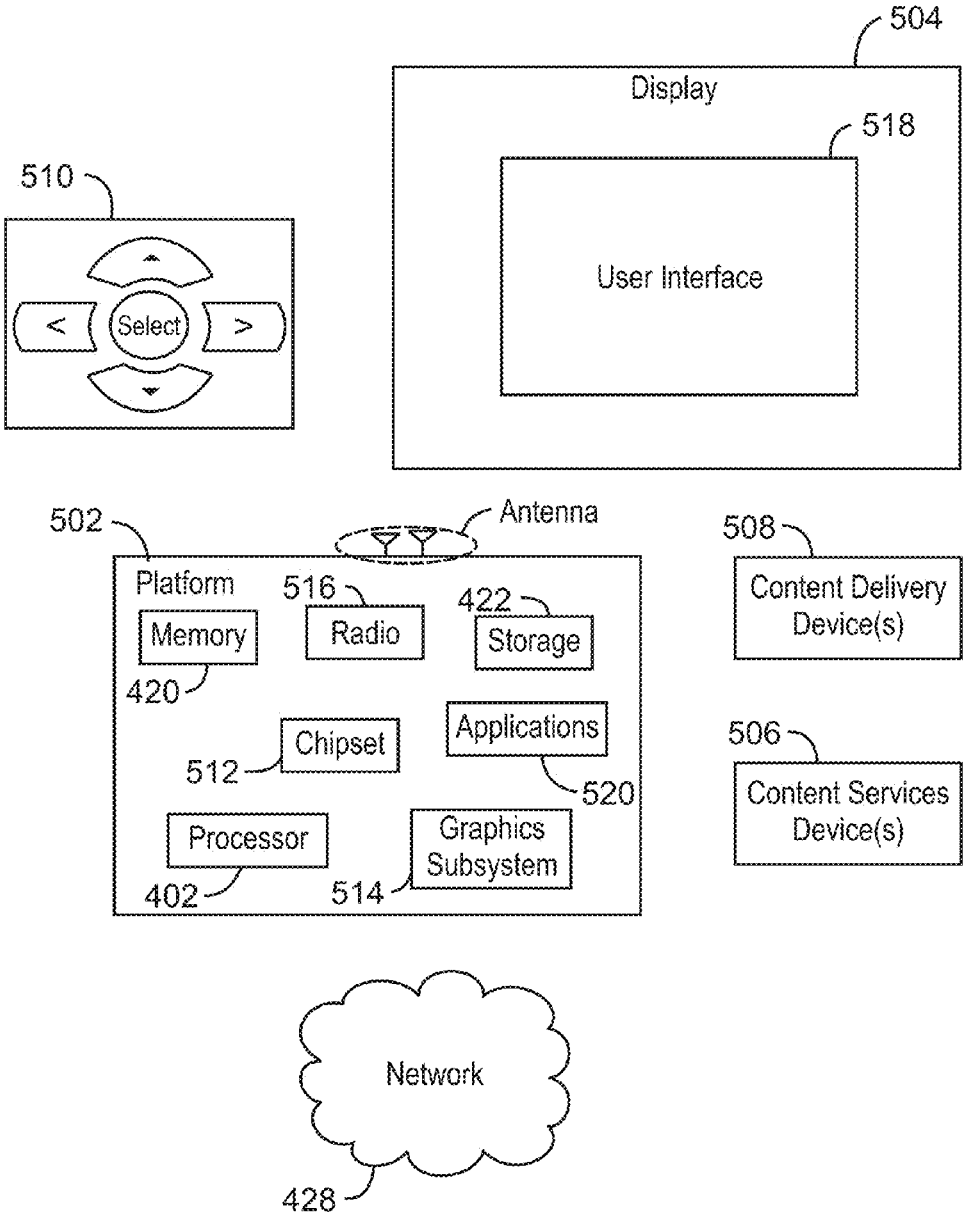
FIG. 5 is a block diagram of an exemplary system that executes analog current level control dimming with linearity compensation.

FIG. 5 is a block diagram of an exemplary system 500 that executes analog current level control dimming with linearity compensation. Like numbered items are as described with respect to FIG. 4. In some embodiments, the system 500 is a media system. In addition, the system 500 may be incorporated into a personal computer (PC), laptop computer, ultra-laptop computer, server computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, a printing device, an embedded device or the like.

In various embodiments, the system 500 comprises a platform 502 coupled to a display 504. The platform 502 may receive content from a content device, such as content services device(s) 506 or content delivery device(s) 508, or other similar content sources. A navigation controller 510 including one or more navigation features may be used to interact with, for example, the platform 502 and/or the display 504. Each of these components is described in more detail below.

The platform 502 may include any combination of a chipset 512, a central processing unit (CPU) 402, a memory device 420, a storage device 422, a graphics subsystem 514, applications 520, and a radio 516. The chipset 512 may provide intercommunication among the CPU 402, the memory device 420, the storage device 422, the graphics subsystem 514, the applications 520, and the radio 516. For example, the chipset 512 may include a storage adapter (not shown) capable of providing intercommunication with the storage device 422.

In some embodiments, the platform 502 is a system on chip (SOC) device. Accordingly, any combination of a chipset 512, CPU 402, a memory device 420, a storage device 422, a graphics subsystem 514, applications 520, and a radio 516 may be integrated into a single package. In some embodiments, the platform 502 may be an SOC device that is included in a mobile phone or a smartphone. The combination of the chipset 512, CPU 402, the memory device 420, the storage device 422, the graphics subsystem 514, applications 520, and the radio 516 may be included in the mobile phone or smartphone on the SOC device. Additionally, the platform 502 may be an SOC device that is included in a tablet device. The combination of the chipset 512, CPU 402, the memory device 420, the storage device 422, the graphics subsystem 514, applications 520, and the radio 516 may be included in the tablet device on the SOC device. Although the combination of the chipset 512, CPU 402, the memory device 420, the storage device 422, the graphics subsystem 514, applications 520, and the radio 516 are described as integrated into an SOC device, the SOC device may include other logic blocks than those presently described.

The CPU 402 may be implemented as Complex Instruction Set Computer (CISC) or Reduced Instruction Set Computer (RISC) processors, x86 instruction set compatible processors, multi-core, or any other microprocessor or central processing unit (CPU). In some embodiments, the CPU 402 includes multi-core processor(s), multi-core mobile processor(s), or the like. The memory device 420 may be implemented as a volatile memory device such as, but not limited to, a Random Access Memory (RAM), Dynamic Random Access Memory (DRAM), or Static RAM (SRAM). The storage device 422 may be implemented as a non-volatile storage device such as, but not limited to, a magnetic disk drive, optical disk drive, tape drive, solid state drive, an internal storage device, an attached storage device, flash memory, battery backed-up SDRAM (synchronous DRAM), and/or a network accessible storage device. In some embodiments, the storage device 422 includes technology to increase the storage performance enhanced protection for valuable digital media when multiple hard drives are included, for example.

The graphics subsystem 514 may perform processing of images such as still or video for display. The graphics subsystem 514 may include a graphics processing unit (GPU), such as the GPU 404, or a visual processing unit (VPU), for example. An analog or digital interface may be used to communicatively couple the graphics subsystem 514 and the display 504. For example, the interface may be any of a High-Definition Multimedia Interface, DisplayPort, wireless HDMI, and/or wireless HD compliant techniques. The graphics subsystem 514 may be integrated into the CPU 402 or the chipset 512. Alternatively, the graphics subsystem 514 may be a stand-alone card communicatively coupled to the chipset 512.

The graphics and/or video processing techniques described herein may be implemented in various hardware architectures. For example, graphics and/or video functionality may be integrated within the chipset 512. Alternatively, a discrete graphics and/or video processor may be used. As still another embodiment, the graphics and/or video functions may be implemented by a general purpose processor, including a multi-core processor. In a further embodiment, the functions may be implemented in a consumer electronics device.

The radio 516 may include one or more radios capable of transmitting and receiving signals using various suitable wireless communications techniques. Such techniques may involve communications across one or more wireless networks. Exemplary wireless networks include wireless local area networks (WLANs), wireless personal area networks (WPANs), wireless metropolitan area network (WMANs), cellular networks, satellite networks, or the like. In communicating across such networks, the radio 516 may operate in accordance with one or more applicable standards in any version.

The display 504 may include any television type monitor or display. For example, the display 504 may include a computer display screen, touch screen display, video monitor, television, or the like. The display 504 may be digital and/or analog. In some embodiments, the display 504 is a holographic display. Also, the display 504 may be a transparent surface that may receive a visual projection. Such projections may convey various forms of information, images, objects, or the like. For example, such projections may be a visual overlay for a mobile augmented reality (MAR) application. Under the control of one or more applications 520, the platform 502 may display a user interface 518 on the display 504.

The content services device(s) 506 may be hosted by any national, international, or independent service and, thus, may be accessible to the platform 502 via the Internet, for example. The content services device(s) 506 may be coupled to the platform 502 and/or to the display 504. The platform 502 and/or the content services device(s) 506 may be coupled to a network 428 to communicate (e.g., send and/or receive) media information to and from the network 428. The content delivery device(s) 508 also may be coupled to the platform 502 and/or to the display 504.

The content services device(s) 506 may include a cable television box, personal computer, network, telephone, or Internet-enabled device capable of delivering digital information. In addition, the content services device(s) 506 may include any other similar devices capable of unidirectionally or bidirectionally communicating content between content providers and the platform 502 or the display 504, via the network 428 or directly. It will be appreciated that the content may be communicated unidirectionally and/or bidirectionally to and from any one of the components in the system 500 and a content provider via the network 428. Examples of content may include any media information including, for example, video, music, medical and gaming information, and so forth.

The content services device(s) 506 may receive content such as cable television programming including media information, digital information, or other content. Examples of content providers may include any cable or satellite television or radio or Internet content providers, among others.

In some embodiments, the platform 502 receives control signals from the navigation controller 510, which includes one or more navigation features. The navigation features of the navigation controller 510 may be used to interact with the user interface 518, for example. The navigation controller 510 may be a pointing device or a touchscreen device that may be a computer hardware component (specifically human interface device) that allows a user to input spatial (e.g., continuous and multi-dimensional) data into a computer. Many systems such as graphical user interfaces (GUI), and televisions and monitors allow the user to control and provide data to the computer or television using physical gestures. Physical gestures include but are not limited to facial expressions, facial movements, movement of various limbs, body movements, body language or any combinations thereof. Such physical gestures can be recognized and translated into commands or instructions.

Movements of the navigation features of the navigation controller 510 may be echoed on the display 504 by movements of a pointer, cursor, focus ring, or other visual indicators displayed on the display 504. For example, under the control of the applications 520, the navigation features located on the navigation controller 510 may be mapped to virtual navigation features displayed on the user interface 518. In some embodiments, the navigation controller 510 may not be a separate component but, rather, may be integrated into the platform 502 and/or the display 504.

The system 500 may include drivers (not shown) that include technology to enable users to instantly turn on and off the platform 502 with the touch of a button after initial boot-up, when enabled, for example. Program logic may allow the platform 502 to stream content to media adaptors or other content services device(s) 506 or content delivery device(s) 508 when the platform is turned "off." In addition, the chipset 512 may include hardware and/or software support for 5.1 surround sound audio and/or high definition 7.1 surround sound audio, for example. The drivers may include a graphics driver for integrated graphics platforms. In some embodiments, the graphics driver includes a peripheral component interconnect express (PCIe) graphics card.

In various embodiments, any one or more of the components shown in the system 500 may be integrated. For example, the platform 502 and the content services device(s) 506 may be integrated; the platform 502 and the content delivery device(s) 508 may be integrated; or the platform 502, the content services device(s) 506, and the content delivery device(s) 508 may be integrated. In some embodiments, the platform 502 and the display 504 are an integrated unit. The display 504 and the content service device(s) 506 may be integrated, or the display 504 and the content delivery device(s) 508 may be integrated, for example.

The system 500 may be implemented as a wireless system or a wired system. When implemented as a wireless system, the system 500 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum. When implemented as a wired system, the system 500 may include components and interfaces suitable for communicating over wired communications media, such as input/output (I/O) adapters, physical connectors to connect the I/O adapter with a corresponding wired communications medium, a network interface card (NIC), disc controller, video controller, audio controller, or the like. Examples of wired communications media may include a wire, cable, metal leads, printed circuit board (PCB), backplane, switch fabric, semiconductor material, twisted-pair wire, co-axial cable, fiber optics, or the like.

The platform 502 may establish one or more logical or physical channels to communicate information. The information may include media information and control information. Media information may refer to any data representing content meant for a user. Examples of content may include, for example, data from a voice conversation, videoconference, streaming video, electronic mail (email) message, voice mail message, alphanumeric symbols, graphics, image, video, text, and the like. Data from a voice conversation may be, for example, speech information, silence periods, background noise, comfort noise, tones, and the like. Control information may refer to any data representing commands, instructions or control words meant for an automated system. For example, control information may be used to route media information through a system, or instruct a node to process the media information in a predetermined manner. The embodiments, however, are not limited to the elements or the context shown or described in FIG. 5.

Figure 6:
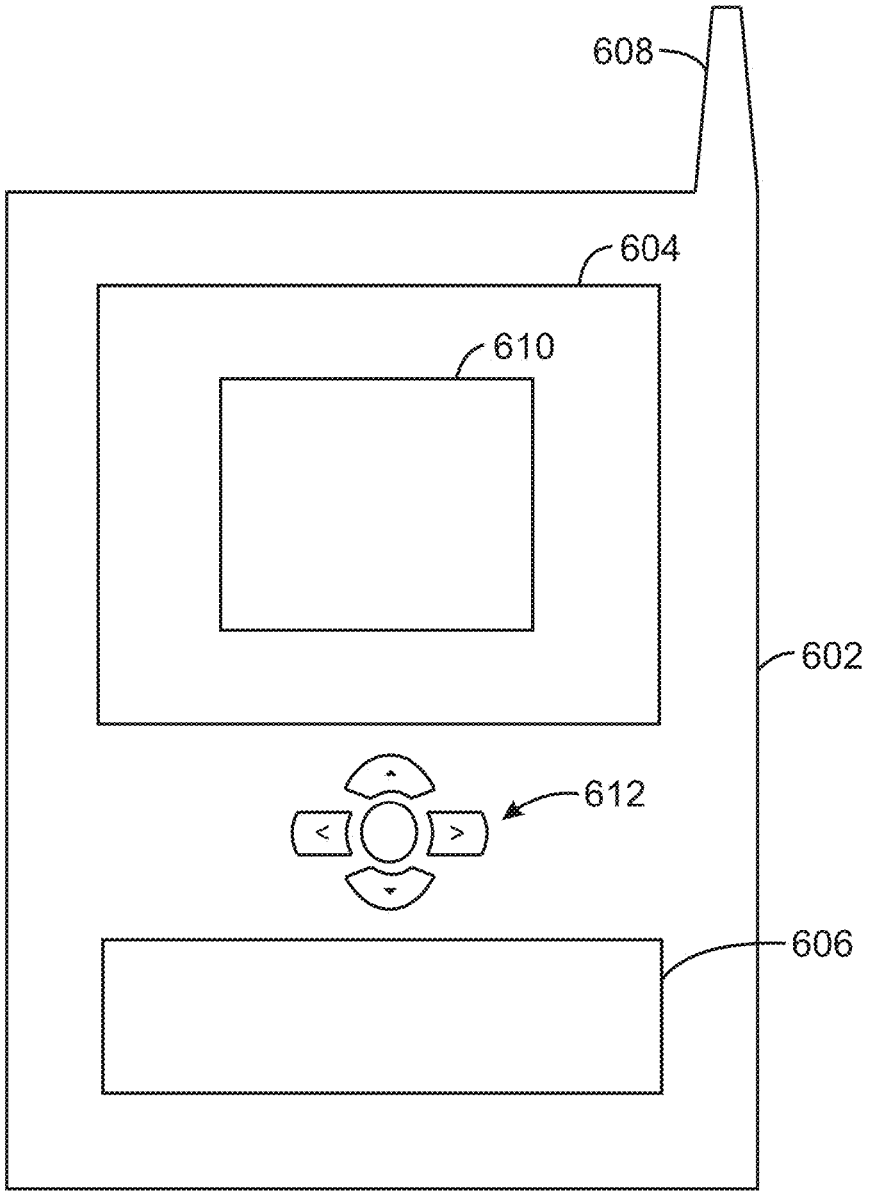
FIG. 6 is a schematic of a small form factor device in which the system of FIG. 5 may be embodied.

FIG. 6 is a schematic of a small form factor device 600 in which the system 500 of FIG. 5 may be embodied. In some embodiments, for example, the device 600 is implemented as a mobile computing device having wireless capabilities. A mobile computing device may refer to any device having a processing system and a mobile power source or supply, such as one or more batteries, for example.

As described above, examples of a mobile computing device may include a personal computer (PC), laptop computer, ultra-laptop computer, server computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and the like.

An example of a mobile computing device may also include a computer that is arranged to be worn by a person, such as a wrist computer, finger computer, ring computer, eyeglass computer, belt-clip computer, arm-band computer, shoe computer, clothing computer, or any other suitable type of wearable computer. For example, the mobile computing device may be implemented as a smart phone capable of executing computer applications, as well as voice communications and/or data communications. Although some embodiments may be described with a mobile computing device implemented as a smart phone by way of example, it may be appreciated that other embodiments may be implemented using other wired or wireless mobile computing devices as well.

As shown in FIG. 6, the device 600 may include a housing 602, a display 604, an input/output (I/O) device 606, and an antenna 608. The device 600 may also include navigation features 612. The display 604 may include any suitable display 610 unit for displaying information appropriate for a mobile computing device. The I/O device 606 may include any suitable I/O device for entering information into a mobile computing device. For example, the I/O device 606 may include an alphanumeric keyboard, a numeric keypad, a touch pad, input keys, buttons, switches, rocker switches, microphones, speakers, a voice recognition device and software, or the like. Information may also be entered into the device 600 by way of microphone. Such information may be digitized by a voice recognition device.

Figure 7:
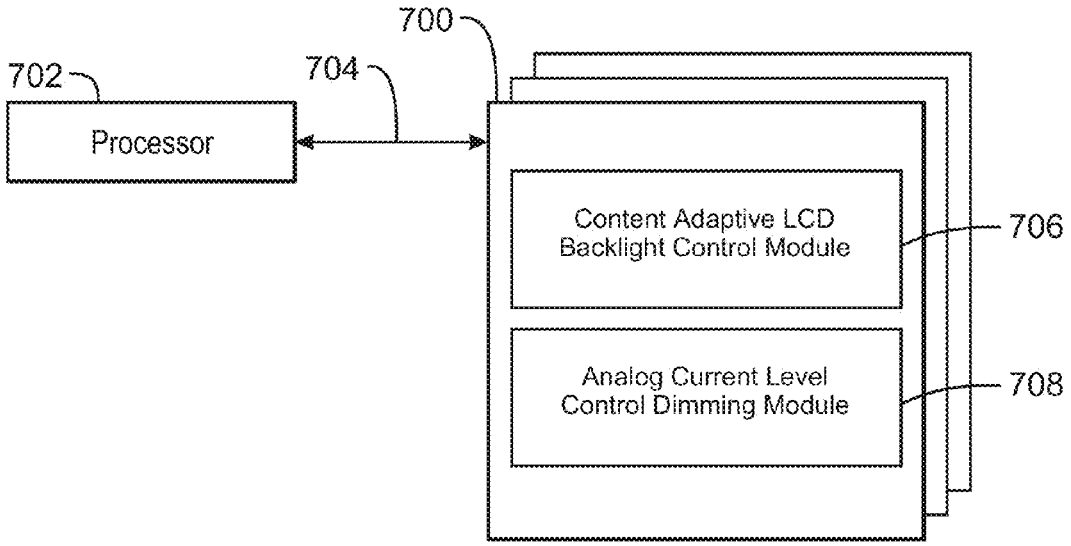
FIG. 7 is a block diagram showing tangible, non-transitory computer-readable media that stores code for content adaptive LCD backlight control with analog current level control dimming and linearity compensation.

FIG. 7 is a block diagram showing tangible, non-transitory computer-readable media 700 that stores code for content adaptive LCD backlight control with analog current level control dimming and linearity compensation. The tangible, non-transitory computer-readable media 700 may be accessed by a processor 702 over a computer bus 704. Furthermore, the tangible, non-transitory computer-readable medium 700 may include code configured to direct the processor 702 to perform the methods described herein.

The various software components discussed herein may be stored on one or more tangible, non-transitory computer-readable media 700, as indicated in FIG. 7. For example, a content adaptive LCD backlight control module 706 may be configured to process pixels using content adaptive LCD backlight control. An analog current level control dimming module 708 may be configured to perform analog current level control dimming when processing the pixels. The analog current level control dimming module 708 may also linearly compensate for the analog current level control dimming when processing the pixels. In some embodiments, an additional module linearly compensates for the analog current level control dimming when processing the pixels.

The block diagram of FIG. 7 is not intended to indicate that the tangible, non-transitory computer-readable medium 700 is to include all of the components shown in FIG. 7. Further, the tangible, non-transitory computer-readable medium 700 may include any number of additional components not shown in FIG. 7, depending on the details of the specific implementation.

Example 1

An apparatus is described herein. The apparatus at least partially includes hardware logic, process pixels using content adaptive LCD backlight control, perform analog current level control dimming when processing the pixels, and linearly compensate for the analog current level control dimming when performing analog current level control dimming.

Logic to linearly compensate for the analog current level control dimming may include modifying a value of the pixels. Logic to linearly compensate for the analog current level control dimming may include determining an amount to reduce an LED backlight. Logic to perform analog current level control dimming may also include a linearity algorithm to reduce an analog current level to a level that produces a correct pixel value when applied to content adaptive LCD backlight control. Additionally, the may include logic to obtain an analog current level control dimming value when linearly compensating for the analog current level control dimming, logic to obtain a plurality of enhanced pixels when performing analog current level control dimming when processing the pixels, and logic to obtain a liquid crystal display (LCD) panel with a light emitting diode (LED) backlight display setting by combining the analog current level control dimming value and the plurality of enhanced pixels. A power consumption of an LED backlight may be reduced. Further, the content adaptive LCD backlight control include Display Power Saving Technology.

Example 2

A computing device is described herein. The computing device includes an LCD panel with an LED backlight, wherein the computing device includes logic that is configured to apply an analog current level control value to the LED backlight based on a plurality of pixels, wherein the LED backlight is dimmed using the analog current level control value with a linear compensation.

The analog current level control value may be calculated from hardware based image statics processed to obtain a PWM ratio for the LED backlight. The image statistics may be one or more histograms of pixel data. Further, the histogram May be generated based on a Y value of a YUV color space. The plurality of pixels may be enhanced based on the histogram. Additionally, the power consumption of the LED backlight may be reduced using an analog current level control value. Additionally, the logic may at least partially comprise a processor.

Example 3

At least one machine readable medium is described herein. The machine readable medium has instructions stored therein that, in response to being executed on a computing device, cause the computing device to process pixels using content adaptive LCD backlight control, perform analog current level control dimming when processing the pixels, and linearly compensate for the analog current level control dimming when processing the pixels.

Linearly compensating for the analog current level control dimming may include modifying a value of the pixels. Further, to linearly compensate for the analog current level control dimming may include determining an amount to reduce an LED backlight. Moreover, analog current level control dimming may include a linearity algorithm to reduce an analog current level to a level that produces a correct pixel value when applied to content adaptive LCD backlight control. Additionally, an analog current level control dimming value may be obtained when linearly compensating for the analog current level control dimming, a plurality of enhanced pixels obtained when performing analog current level control dimming when processing the pixels, and a liquid crystal display (LCD) panel with a light emitting diode (LED) backlight display setting obtained by combining the analog current level control dimming value and the plurality of enhanced pixels. A power consumption of an LED backlight may be reduced, and the content adaptive LCD backlight control may include Intel® Display Power Saving Technology (DPST).

It is to be understood that specifics in the aforementioned examples may be used anywhere in one or more embodiments. For instance, all optional features of the computing device described above may also be implemented with respect to either of the methods or the computer-readable medium described herein. Furthermore, although flow diagrams and/or state diagrams may have been used herein to describe embodiments, the inventions are not limited to those diagrams or to corresponding descriptions herein. For example, flow need not move through each illustrated box or state or in exactly the same order as illustrated and described herein.

The inventions are not restricted to the particular details listed herein. Indeed, those skilled in the art having the benefit of this disclosure will appreciate that many other variations from the foregoing description and drawings may be made within the scope of the present inventions. Accordingly, it is the following claims including any amendments thereto that define the scope of the inventions.

What is claimed is:

1. An apparatus at least partially comprising hardware logic, wherein the logic is configured to:

process pixels using content adaptive LCD backlight control;

perform analog current level control dimming when processing the pixels, wherein a duty cycle of the analog current level control dimming is lower than a duty cycle of a pulse width modulation dimming; and linearly compensate for the analog current level control dimming when performing analog current level control dimming.

2. The apparatus of claim 1, wherein logic to linearly compensate for the analog current level control dimming includes modifying a value of the pixels.

3. The apparatus of claim 1, wherein logic to linearly compensate for the analog current level control dimming includes determining an amount to reduce an LED backlight.

4. The apparatus of claim 1, wherein logic to perform analog current level control dimming comprises a linearity algorithm to reduce an analog current level to a level that produces a correct pixel value when applied to content adaptive LCD backlight control.

5. The apparatus of claim 1, wherein the logic includes:

logic to obtain an analog current level control dimming value when linearly compensating for the analog current level control dimming;

logic to obtain a plurality of enhanced pixels when performing analog current level control dimming when processing the pixels; and logic to obtain a liquid crystal display (LCD) panel with a light emitting diode (LED) backlight display setting by combining the analog current level control dimming value and the plurality of enhanced pixels.

6. The apparatus of claim 1, wherein a power consumption of an LED backlight is reduced.

7. The apparatus of claim 1, wherein the apparatus comprises an LCD panel with an LED backlight.

8. A computing device, comprising:

an LCD panel with an LED backlight, wherein the computing device includes logic that is configured to apply an analog current level control value to the LED backlight based on a plurality of pixels, wherein a duty cycle of the analog current level control dimming is lower than a duty cycle of a pulse width modulation dimming and wherein the LED backlight is dimmed using the analog current level control value with a linear compensation.

9. The computing device of claim 8, wherein the analog current level control value is calculated from hardware based image statics processed to obtain a PWM ratio for the LED backlight.

10. The computing device of claim 9, wherein the image statistics are one or more histograms of pixel data.

11. The computing device of claim 10, wherein the histogram is generated based on a Y value of a YUV color space.

12. The computing device of claim 11, wherein the plurality of pixels is enhanced based on the histogram.

13. The computing device of claim 8, wherein the power consumption of the LED backlight is reduced using an analog current level control value.

14. The computing device of claim 8, wherein the logic at least partially comprises a processor.

15. At least one non-transitory machine readable medium having instructions stored therein that, in response to being executed on a computing device, cause the computing device to:

process pixels using content adaptive LCD backlight control;

perform analog current level control dimming when processing the pixels, wherein a duty cycle of the analog current level control dimming is lower than a duty cycle of a pulse width modulation dimming; and linearly compensate for the analog current level control dimming when processing the pixels.

16. The at least one non-transitory machine readable medium of claim 15, wherein linearly compensating for the analog current level control dimming includes modifying a value of the pixels.

17. The at least one non-transitory machine readable medium of claim 15, wherein to linearly compensate for the analog current level control dimming includes determining an amount to reduce an LED backlight.

18. The at least one non-transitory machine readable medium of claim 15, wherein analog current level control dimming comprises a linearity algorithm to reduce an analog current level to a level that produces a correct pixel value when applied to content adaptive LCD backlight control.

19. The at least one non-transitory machine readable medium of claim 15, further comprising:

obtaining an analog current level control dimming value when linearly compensating for the analog current level control dimming;

obtaining a plurality of enhanced pixels when performing analog current level control dimming when processing the pixels; and obtaining a liquid crystal display (LCD) panel with a light emitting diode (LED) backlight display setting by combining the analog current level control dimming value and the plurality of enhanced pixels.

20. The at least one non-transitory machine readable medium of claim 15, wherein a power consumption of an LED backlight is reduced.

21. The at least one non-transitory machine readable medium of claim 15, wherein the pixels are enhanced based on a histogram, where the histogram includes image statistics.

* * * * *